US011359321B2

(12) United States Patent
Daniels

(10) Patent No.: US 11,359,321 B2
(45) Date of Patent: Jun. 14, 2022

(54) SYSTEM AND METHOD FOR VARYING OZONE PRODUCTION BASED UPON OZONE DEMAND

(71) Applicant: Ralph G. Daniels, Derry, NH (US)

(72) Inventor: Ralph G. Daniels, Derry, NH (US)

( * ) Notice: Subject to any disclaimer, the term of this patent is extended or adjusted under 35 U.S.C. 154(b) by 480 days.

(21) Appl. No.: 16/193,389

(22) Filed: Nov. 16, 2018

(65) Prior Publication Data

US 2019/0153649 A1 May 23, 2019

Related U.S. Application Data

(60) Provisional application No. 62/587,770, filed on Nov. 17, 2017.

(51) Int. Cl.
*D06F 35/00* (2006.01)
*D06F 31/00* (2006.01)
*D06F 34/14* (2020.01)

(52) U.S. Cl.
CPC ..... *D06F 35/001* (2013.01); *D06F 31/00* (2013.01); *D06F 34/14* (2020.02)

(58) Field of Classification Search
CPC ..... D06F 35/001; D06F 34/14; D06F 31/00
See application file for complete search history.

(56) References Cited

U.S. PATENT DOCUMENTS 5,313,811 A * 5/1994 Wasinger ..... D06L 4/50 68/5 C
8,667,817 B2 * 3/2014 Smith ..... D06F 35/001 68/5 R
10,000,880 B1 * 6/2018 Borchard ..... C02F 1/008
2008/0092601 A1 * 4/2008 Konides ..... D06F 35/001 29/401.1
2008/0159907 A1 * 7/2008 Joshi ..... A61L 2/202 422/5
2008/0302139 A1 * 12/2008 Zorn ..... D06F 31/00 68/12.18
2010/0313610 A1 * 12/2010 Smith ..... D06F 31/005 68/13 R
2011/0036761 A1 * 2/2011 Chen ..... C02F 1/78 210/101
2012/0017379 A1 * 1/2012 Moore ..... D06L 4/50 8/137

(Continued)

*Primary Examiner* — Benjamin L Osterhout
(74) *Attorney, Agent, or Firm* — Finch & Maloney PLLC; Michael J. Bujold; Jay S. Franklin

(57) ABSTRACT

An ozone production method and system for producing ozone which comprises a plurality of washing machines, an ozone generator for generating ozone, and an ozone supply conduit for supplying ozone from the ozone generator to the washing machines. Each washing machine has a respective venturi, located between a water source and an inlet to the washing machine. The venturi is connected to the ozone supply conduit so that, as water flows through the respective venturi, such water flow creates a negative pressure within the ozone supply conduit. At least one sensor is located so as to detect the negative pressure created within the ozone supply conduit. The at least one sensor is connected to a control box, coupled to the ozone generator, which controls ozone production of the ozone generator depending upon the negative pressure generated within the ozone supply conduit.

19 Claims, 3 Drawing Sheets

(56) References Cited

U.S. PATENT DOCUMENTS

| | | | | |
|---|---|---|---|---|
| 2012/0070352 | A1* | 3/2012 | Eglmeier | D06F 35/001 423/219 |
| 2013/0146516 | A1* | 6/2013 | Chen | B01F 5/0693 210/143 |

* cited by examiner

SYSTEM AND METHOD FOR VARYING OZONE PRODUCTION BASED UPON OZONE DEMAND

FIELD OF THE INVENTION

The present disclosure relates to a system for supplying ozone to a plurality of washing machines, via a plurality of respective venturis, in which the system monitors the negative pressure generated within the ozone supply conduit and utilizes the determine negative pressure in order to control the production of ozone being supplied to the plurality of washing machines.

BACKGROUND OF THE INVENTION

The use of ozone in cleaning and sanitizing laundry has been utilized for quite some time. The primary reason is that ozone is generally recognized as being effective in cleaning as well as deodorizing and sanitizing laundry while also minimizing the impact to the environment. With respect to commercial applications, however, ozone is generally the preferred cleaning component as it is relatively inexpensive to manufacture and quite reliable in sanitizing and deodorizing laundry being washed.

As is well known, the application of ozone to a cleaning fluid, such as water, acts as a disinfectant as well as assists with removing dirt, debris, soil and other contaminants from the laundry detergent so that the laundry detergent can again be effective in removing additional dirt, debris, soil and other contaminants from the clothing or other laundry being washed. While it is known that dissolving ozone in a liquid, such as water, will assist with improving the cleaning and sterilization efficiency of the liquid, a number of the currently available prior art systems suffer a variety of associated drawbacks.

It is to appreciated that washing laundry can be a relatively expensive process. It utilizes costly resources—water, energy, laundry detergents and labor—and such laundering is often required not only to clean but completely disinfect and sanitize the items being laundered. While conventional detergents, soap and chemistry can be effective in removing dirt, grease, grime and other contaminants, they are not always effective in killing all of the germs and bacteria contained within the laundry being washed. It is known that by introducing ozone into the washing water the disinfection capabilities of a washing machine can be enhanced. Added ozone improves cleaning of laundry, even at relatively low or cold wash water temperatures, and also has an antibacterial effect.

SUMMARY OF THE INVENTION

Wherefore, it is an object of the present disclosure to overcome the above mentioned shortcomings and drawbacks associated with the prior art.

Another object of the present disclosure is to provide an ozone production system which generates the required amount of ozone, to accommodate the demand of a plurality of washing machines, without generating an excess amount of ozone.

A further object of the present disclosure is to provide a system which facilitates the production of ozone so that the system only generates a desired amount of ozone which is required by the washing machines while avoiding production of access ozone.

Yet another object of the present disclosure is to generate ozone from room air which is dried and thereby eliminate the need to use an oxygen concentrator which increases the amount of oxygen present in the air supplied to the ozone generator.

Still another object of the present disclosure is to minimize the amount of ozone which is dissolved into the water being supplied to the washing machine so that a majority of the ozone remains in a gaseous state and is ready to react with the soiled laundry instead of reacting and cleaning the water being supplied to the washing machine.

Yet another object of the present disclosure is to only add ozone to the water immediately before the water enters into the washing machine so that the ozone is more prone to react with the soiled laundry being washed then with the water being supplied to the washing machine to wash the laundry.

The present disclosure also relates to an ozone production system for producing ozone, the ozone production system comprising a plurality of washing machines; an ozone generator for generating ozone for supply to the plurality of washing machines; an ozone supply conduit for supplying ozone from the ozone generator to each of the plurality of washing machines; and each one of the plurality of washing machines having a respective venturi located along a water supply conduit, between a water source and an inlet into the respective washing machine, and the venturi being connected to the ozone supply conduit so that, as water flows through the respective venturi from the water source into the respective washing machine, such water flow creating a negative pressure within the ozone supply conduit; and wherein at least one sensor is located so as to detect the negative pressure within the ozone supply conduit; and the at least one sensor is connected to a control box, coupled to the ozone generator, which controls ozone production of the ozone generator depending upon the negative pressure detected within the ozone supply conduit by the at least one sensor.

The present disclosure also relates to a method of producing ozone with an ozone production system, the method comprising: providing a plurality of washing machines; generating ozone, via an ozone generator, for supply to each one of the plurality of washing machines; supplying ozone, from the ozone generator to each of the plurality of washing machines, via an ozone supply conduit; locating a respective venturi, for each one of the plurality of washing machines, along a water supply conduit between a water source and an inlet into the respective washing machine, and connecting the ozone supply conduit to each respective venturi for supply of ozone thereto; permitting water to flow through the respective venturi, from the water source into the respective washing machine, so that such water flow creates a negative pressure within the ozone supply conduit; locating at least one sensor so as to detect the negative pressure within the ozone supply conduit; and connecting the at least one sensor to a control box, coupled to the ozone generator, to control ozone production of the ozone generator depending upon the negative pressure detected within the ozone supply conduit by the at least one negative pressure sensor/switch.

BRIEF DESCRIPTION OF THE DRAWINGS

The accompanying drawings, which are incorporated in and constitute a part of the specification, illustrate various embodiments of the disclosure and together with the general description of the disclosure given above and the detailed description of the drawings given below, serve to explain the principles of the invention. The invention will now be described, by way of example, with reference to the accompanying drawings in which.

It should be understood that the drawings are not necessarily to scale and that the disclosed embodiments are sometimes illustrated diagrammatical and in partial views. In certain instances, details which are not necessary for an understanding of this disclosure or which render other details difficult to perceive may have been omitted. It should be understood, of course, that this disclosure is not limited to the particular embodiments illustrated herein.

DETAILED DESCRIPTION OF THE PREFERRED EMBODIMENTS

The present disclosure will be understood by reference to the following detailed description, which should be read in conjunction with the appended drawings. It is to be appreciated that the following detailed description is by way of example only and is not meant to limit, in any way, the scope of the present disclosure.

Figure 1:
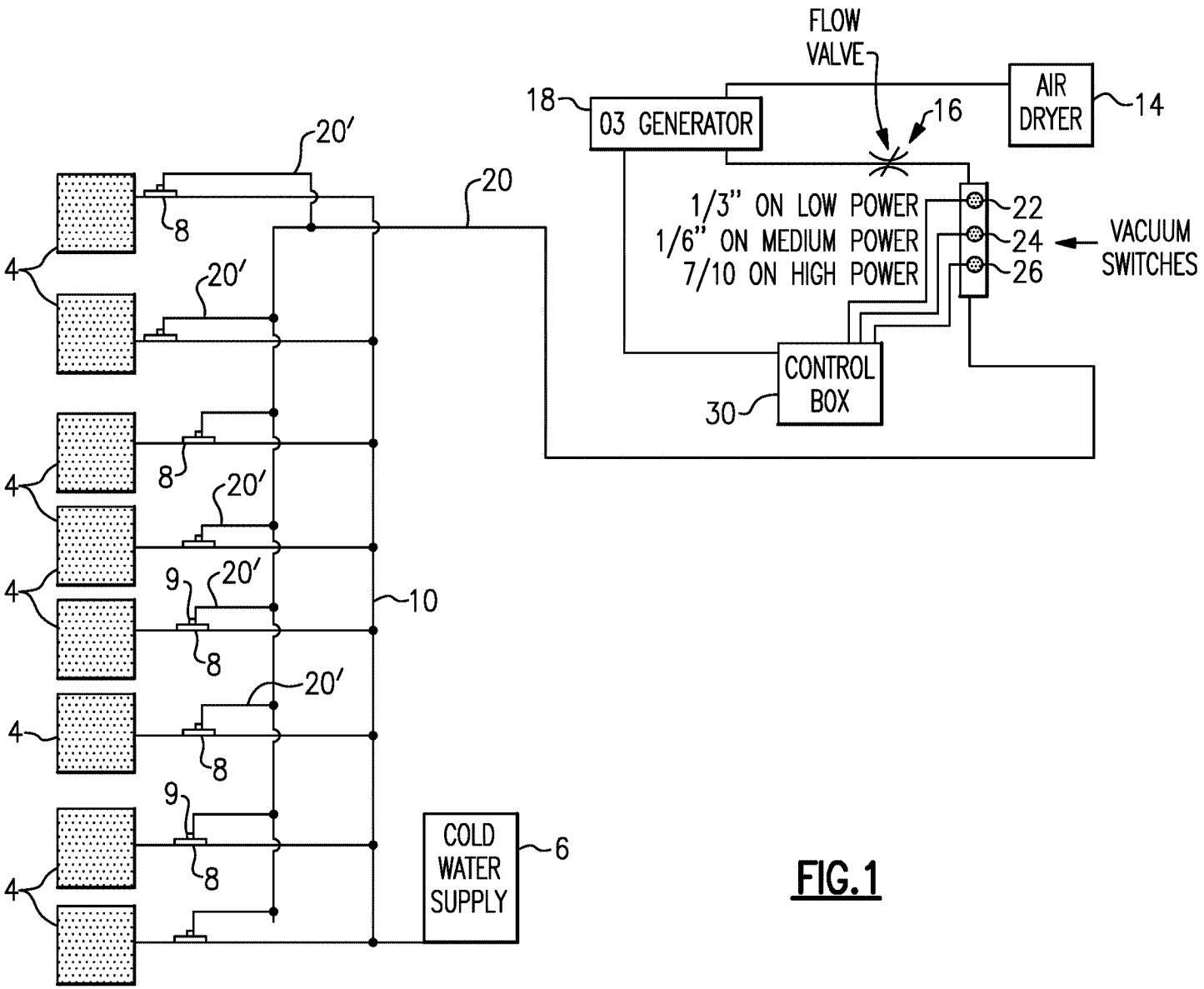
FIG. 1 is a diagrammatic view showing the ozone production system according to the present disclosure.

Turning now to FIG. 1, a brief description concerning the various components will now be briefly discussed. As can be seen in this embodiment, the present disclosure relates to an ozone production system 2 which is designed for producing the required ozone to be supplied to a plurality of washing machines 4 while avoiding excess production of ozone. As diagrammatically shown in FIG. 1, the plurality of washing machines 4 are show and each one of the plurality of washing machines 4 is connected to a conventional water source 6, such as a public water supply, a well, etc., in a conventional manner by water supply conduit 10 to supply wash water thereto. A respective venturi 8 is located along the water supply conduit 10, at a location between the water source 6 and the inlet into the washing machine 4. In practice, the venturi 8 is generally located closely adjacent the inlet to the washing machine 4, e.g., typically between 1 and 30 inches, preferably between about 12 to 15 inches away from the inlet of the washing machine 4. The location of the venturi 8 closely adjacent the inlet to the washing machine 4 minimizes the time that the ozone is contained within the wash water prior to being supplied to an internal drum of the respective washing machine 4 for disinfecting and sanitizing the laundry being washed.

Figure 2:
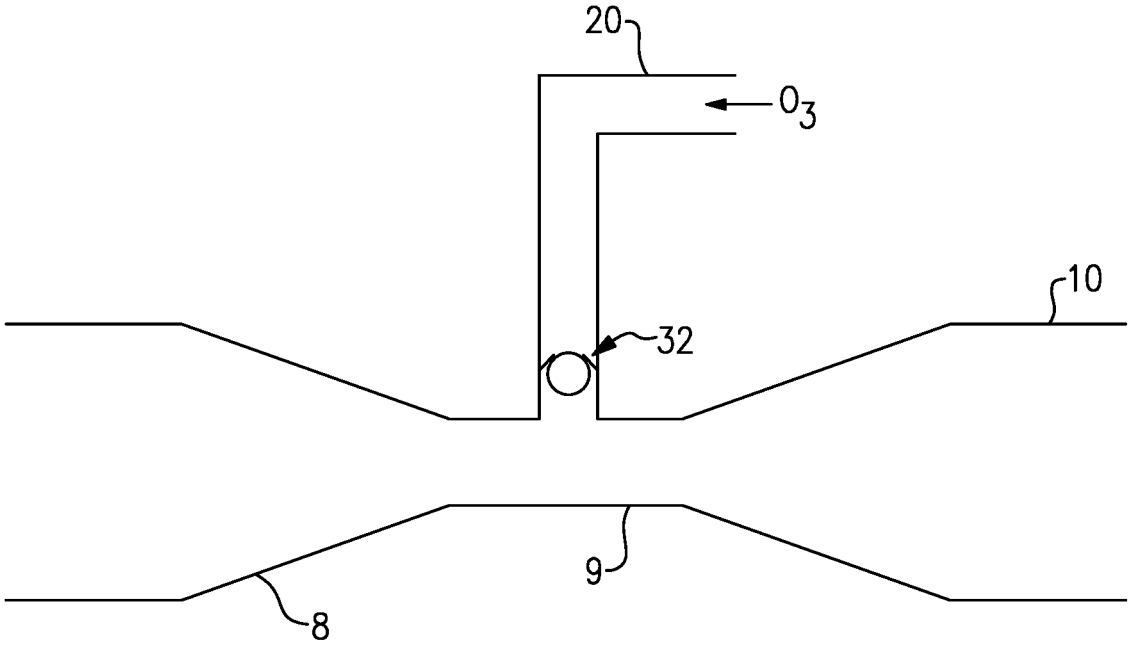
FIG. 2 is a diagrammatic enlarged view showing a venturi.

As is conventional and well known, as the water from the water source 6 flows through the venturi 8 into the internal drum of the washing machine 4, the water is accelerated as it passes through a throat 9 of the venturi 8 (see FIG. 2). Such acceleration of the water, in turn, creates a vacuum in the throat 9 of the venturi 8, the purpose of which will become apparent from the following description. It is to be appreciated that each one of the plurality of washing machines 4 is connected to the water source 6 via a respective venturi 8 in a similar fashion, so that each venturi 8 is able to generate or create a vacuum, in the respective throat 9, as water flows from the water source 6 through the respective venturi 8 toward the respective washing machine 4.

As also diagrammatically shown in FIG. 1, the throat 9 of each venturi 8 is also connected to an ozone supply source 12. The ozone supply source 12 is designed to supply the required amount of ozone to each one of the plurality of washing machines 4. As shown, the ozone supply source 12 generally comprises at least one air dryer 14, or possibly two or more air dryers 14 ("one or more air dryers"), a restrictor module 16, an ozone generator 18 and an ozone supply conduit 20. As the ozone supply conduit 20 extends toward the venturis 8, the ozone supply conduit 20 eventually splits into a plurality of respective ozone supply conduits 20' which are respectively connected to the throat 9 of the respective venturi 8 (see FIG. 2) so that the ozone is supplied to each respective venturi in parallel to one another.

It is to be appreciated that instead of utilizing one or more air dryers 14, for supplying dry air to the ozone generator 18, one or more oxygen concentrators may be utilized to supply concentrated oxygen to ozone generator 18 for conversion into ozone. Alternatively, a combination of both one or more air dryers 14 and one or more oxygen concentrators may be utilizing for supplying both dry and concentrated oxygen to the ozone generator 18.

The one or more air dryers 14 is/are arranged to receive, via an air inlet thereof, a supply of air, typically room air. As the room air enters into one or more air dryers 14, the room air flows over, through and around a bed of silicone pellets (not shown in detail) which remove any moisture contained within the room air, passing through one or more air dryers 14, so that as that air exits from the one or more air dryers 14, that air is substantially dry air.

Each outlet of the one or more air dryers 14 is connected to supply the dry air to an inlet of the ozone generator 18 where the dried air is then converted, in a conventional manner, into ozone. As such conversion or air into ozone is conventional an well known in the art, a further discussion concerning the same is not provided. An outlet of the ozone generator 18 is connected to supply the generated ozone to an inlet of the restrictor module 16. The restrictor module 16 is designed to assist with generating a desired amount of negative pressure in the ozone supply conduit 20. This negative pressure assists with drawing the generated ozone into the inlet of the restrictor module 16. Preferably the restrictor module 16 is adjustable or variable so that the restrictor module 16 provides, either a manual or possibly an automated, adjustment of the amount of ozone which is able to pass therethrough and flow along the ozone supply conduit 20 and thereby alter the amount of negative pressure which is able to be generated within the ozone supply conduit 20. That is, the adjustable or variable restrictor module 16 is able to vary a size to the constriction or passage through the adjustable or variable restrictor module 16 so as vary the size of the "bottleneck" provided by the adjustable or variable restrictor module 16.

A plurality of negative pressure sensors/switches 22, 24, 26 (three of which are shown in FIG. 1), for determining the negative pressure generated within the ozone supply conduit 20, are arranged downstream of the restrictor module 16. The negative pressure sensors/switches 22, 24, 26 are typically located adjacent the restrictor module 16, but this is not mandatory. As discussed below, it is to be appreciated that the plurality of negative pressure sensors/switches 22, 24, 26 may be replaced by a single negative pressure sensor 26' which displays, indicates or otherwise determines the actual negative pressure generated within the ozone supply conduit 20. Normally, the ozone supply conduit 20 is a relatively small diameter supply line, e.g., typically having an inside diameter of between about 0.5 to about 0.25 inches or so.

As shown in this embodiment, first, second and third negative pressure sensors/switches 22, 24, 26 are located downstream of the restrictor module 16 and each one of the first, second and third negative pressure sensors/switches 22, 24, 26 are set to detect a different negative pressure level. According to one embodiment, the first negative pressure sensor/switch 22 may be set to detect a negative pressure level which is between 0 and 4 inches of water, typically between about 1 and about 3 inches of water, the second negative pressure sensor/switch 24 may be set to detect a negative pressure level which is between 3 and 7 inches of water, typically between about 4 and about 6 inches of water, and the third negative pressure sensor/switch 26 may be set to detect a negative pressure level which is greater than about 6 inches of water, typically greater than 7 inches of water. It is to be appreciated that the number of negative pressure sensors/switches 22, 24, 26 as well as the detected negative pressure levels can be varied, from application to application, without departing from the spirit and scope of the present invention.

Each one of the first, second and third negative pressure sensors/switches 22, 24, 26 is connected to a control box 30 which is designed to control production of ozone by the ozone generator 18. For example, if a negative pressure of only 3 inches or less of water is generated in the ozone supply conduit 20, then only the first negative pressure sensor/switch 22 will be activated by this relatively lower negative pressure while the second and the third negative pressure sensors/switches 24, 26 will not be activated since the negative pressure within the ozone supply conduit 20 is insufficient to active either one of those negative pressure sensors/switches 24, 26. Thus, only an activated signal from the first negative pressure sensor/switch 22 is sent to the control box 30 and the control box 30 then determines, based upon receipt of that single signal, that only a relative small supply of ozone is being demanded by a few of the plurality of washing machines 4 and thus initiate production of a relative small supply or production rate of ozone (depending upon the number of washing machines which are connected to the ozone generator 18).

One the other hand, if a negative pressure of between 4-6 inches of water, for example, is generated in the ozone supply conduit 20, then both the first and the second negative pressure sensors/switches 22, 24 will be activated by such negative pressure while the third negative pressure sensor/switch 26 will not be activated since the negative pressure in the ozone supply conduit 20 is insufficient to active the third negative pressure sensor/switch 26. Thus, the activated signals from both the first and the second negative pressure sensors/switches 22, 24 are sent to the control box 30 and the control box 30 then determines, based upon the two received signals, that a medium supply of ozone is being demanded by the plurality of washing machines 4 and thus initiate production of a medium supply or production rate of ozone (depending upon the number of washing machines which are connected to the ozone generator 18).

Lastly, if a negative pressure of greater than 7 inches of water, for example, is generated in the ozone supply conduit 20, then all three of the first, the second and the third negative pressure sensors/switches 22, 24, 26 will be activated by the generated negative pressure within the ozone supply conduit 20. Thus, the activated signals from all three of the first, the second and the third negative pressure sensors/switches 22, 24, 26 are sent to the control box 30 and the control box 30 then determines, based upon the three received single signals, that a higher or maximum supply of ozone is being demanded by the plurality of washing machines 4 and thus initiate production of a higher or maximum supply or production rate of ozone (depending upon the number of washing machines which are connected to the ozone generator 18).

The first negative pressure sensor/switch 22 is typically set to detect a relatively small amount of negative pressure or vacuum, e.g., a negative pressure or vacuum of about 0.5 inches of water, within the ozone supply conduit 20 which is being created by water flowing through at least one of the venturis 8 into at least one washing machines 4. As soon as at least a relatively small amount of negative pressure or vacuum is detected within the ozone supply conduit 20, the first negative pressure sensor/switch 22 is activated and sends a signal to a control box 30 which instructs the ozone generator 18 to commence production of ozone at least at the lower ozone production rate for supply to the at least one washing machine 4 which requires ozone.

Figure 3:
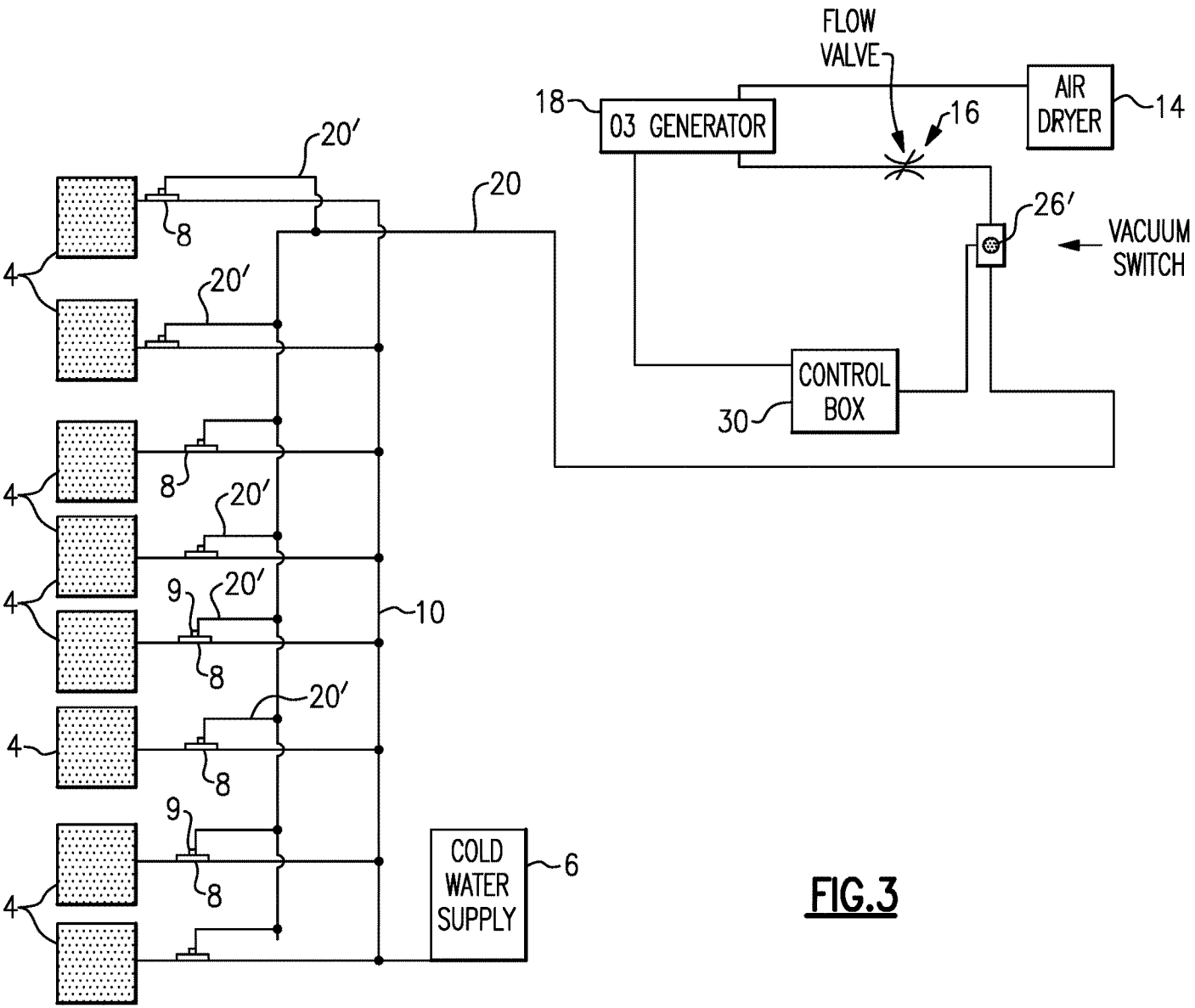
FIG. 3 is a diagrammatic view showing another embodiment of the ozone production system according to the present disclosure.

It is to be appreciated that the number of negative pressure sensor/switches can either be increased or decreased, depending upon particular system or application. Alternatively, rather than using a plurality of negative pressure sensors/switches, as described above, a single negative pressure detector or sensor, as shown in FIG. 3, may be installed in the ozone supply conduit 20 for precisely detecting the negative pressure created within the ozone supply conduit 20. The control box 30 then, based upon this detected or sensed negative pressure by the single negative pressure detector or sensor and sent to the control box 30, can control the ozone generator 18 to vary infinitely the amount of ozone which is produced, by the ozone generator 18, and supplied to the plurality of washing machines 4. According to this embodiment, the control box 30 ensures that a precise amount of ozone is adequately produced and supplied to each one of the plurality of the washing machines 4 to fulfill the necessary ozone demand without producing excess ozone.

As noted above, the ozone generator 18 is located upstream of the restrictor module 16 and the one or more pressure monitor(s)/sensor(s) 22, 24 and 26 for receiving the restricted flow of dry air. This dry air is supplied to the ozone generator 18 which will then generate a desired amount of ozone for supply to the plurality of washing machines 4. Typically, the ozone generator 18 will have at least a lower ozone production level or rate, a medium ozone production level or rate and a higher or maximum ozone production level or rate. Accordingly, when the control box 30 only receives one activation signal, then the control box 30 instructs the ozone generator 18 to operate and produce ozone at the lower ozone production level or rate. If the control box 30 receives two activation signals, then the control box 30 instructs the ozone generator 18 to operate and produce ozone at the medium ozone production level or rate. Conversely, when the control box 30 receives three activation signals, then the control box 30 instructs the ozone generator 18 to operate and produce ozone at the higher or maximum ozone production level or rate. Alternatively, as noted above, the control box 30 may be designed to vary the production of ozone infinitely depending upon the precisely detected or sensed pressure within the ozone supply conduit 20.

As diagrammatically shown in FIG. 1, the ozone generated by the ozone generator 18 then drawn into the restrictor module 16 and flows along the ozone supply conduit 20 toward the venturi 8 of each one of the plurality of washing machines 4 to facilitate suppling ozone to the water as the water, from the water source 6, flows through the respective venturi 8 toward the washing machine 4. A one way check valve 32 is typically located adjacent the connection between a remote end of the ozone supply conduit 20 and the throat 9 of the venturi 8 (see FIG. 2). The one way check valve 32 is arranged so as to permit the ozone to flow only toward and into the water, as the water flows through the venturi and into the internal drum of the washing machine 4, but prevents the water from flowing through the one way check valve 32 and toward the ozone generator 18.

While various embodiments of the present disclosure have been described in detail, it is apparent that various modifications and alterations of those embodiments will occur to and be readily apparent to those skilled in the art. However, it is to be expressly understood that such modifications and alterations are within the scope and spirit of the present disclosure, as set forth in the appended claims. Further, the disclosure(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a !imitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

Wherefore, I claim:

1. An ozone production system for producing ozone, the ozone production system comprising:

a plurality of washing machines;

an ozone generator for generating ozone for supply to the plurality of washing machines;

an ozone supply conduit for supplying ozone from the ozone generator to each one of the plurality of washing machines; and each one of the plurality of washing machines having a respective venturi located along a water supply conduit, between a water source and an inlet into the respective washing machine, and each respective venturi being connected to the ozone supply conduit so that, as water flows through the respective venturi from the water source into the respective washing machine, such water flow creating a negative pressure within the ozone supply conduit; and wherein at least one sensor is located along and communicating with the ozone supply conduit to the plurality of washing machines so as to detect the negative pressure within the ozone supply conduit; and the at least one sensor is connected to a control box, coupled to the ozone generator, which controls ozone production of the ozone generator depending upon a level of the negative pressure detected within the ozone supply conduit by the at least one sensor such that when a lower negative pressure is detected by the at least one sensor in the ozone supply conduit, the at least one sensor sends a signal to the control box to instruct the ozone generator to produce ozone at a lower ozone production rate for supply to the plurality of washing machines, while when a higher negative pressure is detected by the at least one sensor in the ozone supply conduit, the at least one sensor sends a signal to the control box to instruct the ozone generator to produce ozone at a higher ozone production rate for supply to the plurality of washing machines.

2. The ozone production system according to claim 1, wherein the ozone supply conduit is connected to a throat of each respective venturi so that as the water from the water source flows through the respective venturi into the respective washing machine, the water is accelerated and generates a vacuum in the throat of the respective venturi.

3. The ozone production system according to claim 1, wherein each respective venturi is located along the water supply conduit less than about 30 inches away from an inlet of the respective washing machine.

4. The ozone production system according to claim 1, wherein each respective venturi is located along the water supply conduit, adjacent an inlet of the respective washing machine, so as to minimize a duration of time that the ozone is present within wash water prior to the wash water and ozone being supplied to an internal drum of the respective washing machine.

5. The ozone production system according to claim 1, wherein a restrictor module is located downstream of the ozone generator for restricting flow of the ozone, which is generated by the ozone generator, and drawn in by the negative pressure created in the ozone supply conduit.

6. The ozone production system according to claim 5, wherein at least one air dryer is located upstream of the ozone generator for drying air which is supplied to the ozone generator.

7. The ozone production system according to claim 6, wherein the at least one sensor comprises a plurality of negative pressure sensors/switches for determining the negative pressure generated within the ozone supply conduit downstream of the restrictor module.

8. The ozone production system according to claim 6, wherein the air, which passes through the at least one air dryer, flows through a bed of silicone pellets to remove moisture contained within the air so that substantially dry air exits from the at least one air dryer.

9. The ozone production system according to claim 1, wherein the at least one sensor comprises a plurality of negative pressure sensors/switches; and the ozone generator has at least the lower ozone production rate, a medium ozone production rate and the higher ozone production rate, when the control box receives a signal from only one negative pressure sensor/switch, then the control box controls the ozone generator to produce ozone at the lower ozone production rate;

when the control box receives a signal from two negative pressure sensors/switches, then the control box controls the ozone generator to produce ozone at the medium ozone production rate; and when the control box receives a signal from three negative pressure sensors/switches, then the control box controls the ozone generator to produce ozone at the higher ozone production rate.

10. The ozone production system according to claim 1, wherein a one way check valve is located along the ozone supply conduit, adjacent a throat of the respective venturi, and the one way check valve permits the ozone to flow into the water, as the water flows through the respective venturi, but prevents water from flowing through the one way check valve toward the ozone generator.

11. The ozone production system according to claim 1, wherein at least one sensor comprises a plurality of negative pressure sensors/switches for determining the negative pressure generated within the ozone supply conduit.

12. The ozone production system according to claim 11, wherein the plurality of negative pressure sensors/switches comprise first, second and third negative pressure sensors/switches, the first negative pressure sensor/switch detects a negative pressure of between 0 and 4 inches of water, the second negative pressure sensor/switch detects a negative pressure of between 3 and 7 inches of water, and the third negative pressure sensor/switch detects a negative pressure of greater than 6 inches of water.

13. The ozone production system according to claim 1, wherein at least one sensor comprises a single negative pressure detector for detecting the negative pressure created within the ozone supply conduit, and the single negative pressure detector supplies a signal to the control box which varies ozone production based upon the negative pressure detected by the single negative pressure detector.

14. The ozone production system according to claim 13, wherein the ozone generator has at least variable ozone production rate, and the control box controls the ozone generator to produce ozone based upon the negative pressure detected by the at least one negative pressure sensor/switch.

15. An ozone production system for producing ozone, the ozone production system comprising:

a plurality of washing machines;

an ozone generator for generating ozone for supply to the plurality of washing machines;

an ozone supply conduit for supplying ozone from the ozone generator to each of the plurality of washing machines; and each one of the plurality of washing machines having a respective venturi located along a water supply conduit, between a water source and an inlet into the respective washing machine, and a throat of the respective venturi being connected to the ozone supply conduit so that, as water flows through the respective venturi from the water source into the respective washing machine, such water flow creating a negative pressure within the ozone supply conduit, and each respective venturi being located along the water supply conduit less than about 30 inches away from an inlet of the respective washing machine; and wherein at least one sensor is located along and communicating with the ozone supply conduit to the plurality of washing machines so as to detect the negative pressure within the ozone supply conduit;

a one way check valve is located along the ozone supply conduit, adjacent the throat of the respective venturi, and the one way check valve permits the ozone to flow into the water, as the water flows through the respective venturi, but prevents water from flowing through the one way check valve toward the ozone generator; and the at least one sensor is connected to a control box, coupled to the ozone generator, which controls ozone production of the ozone generator depending upon the negative pressure detected within the ozone supply conduit by the at least one sensor such that when a lower negative pressure is detected by the at least one sensor in the ozone supply conduit, the at least one sensor sends a signal to the control box to instruct the ozone generator to produce ozone at a lower ozone production rate for supply to the plurality of washing machines, while when a higher negative pressure is detected by the at least one sensor in the ozone supply conduit, the at least one sensor sends a signal to the control box to instruct the ozone generator to produce ozone at a higher ozone production rate for supply to the plurality of washing machines.

16. The ozone production system according to claim 15, wherein a restrictor module is located downstream of the ozone generator for restricting flow of the ozone, which is generated by the ozone generator, and drawn in by the negative pressure created in the ozone supply conduit.

17. The ozone production system according to claim 16, wherein at least one air dryer is located upstream of the ozone generator for drying air which is supplied to the ozone generator.

18. The ozone production system according to claim 17, wherein the at least one sensor of the ozone production system includes a plurality of negative pressure sensors/switches for determining the negative pressure generated within the ozone supply conduit downstream of the restrictor module.

19. A method of producing ozone with an ozone production system, the method comprising:

providing a plurality of washing machines;

generating ozone, via an ozone generator, for supply to each one of the plurality of washing machines;

supplying ozone, from the ozone generator to each of the plurality of washing machines, via an ozone supply conduit;

locating a respective venturi, for each one of the plurality of washing machines, along a water supply conduit between a water source and an inlet into the respective washing machine, and connecting the ozone supply conduit to each respective venturi for supply of ozone thereto;

permitting water to flow through the respective venturi, from the water source into the respective washing machine, so that such water flow creates a negative pressure within the ozone supply conduit;

locating at least one sensor along and communicating with the ozone supply conduit to the plurality of washing machines so as to detect the negative pressure within the ozone supply conduit; and connecting the at least one sensor to a control box, coupled to the ozone generator, to control ozone production of the ozone generator depending upon the negative pressure detected within the ozone supply conduit by the at least one sensor such that when a lower negative pressure is detected by the at least one sensor in the ozone supply conduit, the at least one sensor sends a signal to the control box to instruct the ozone generator to produce ozone at a lower ozone production rate for supply to the plurality of washing machines, while when a higher negative pressure is detected by the at least one sensor in the ozone supply conduit, the at least one sensor sends a signal to the control box to instruct the ozone generator to produce ozone at a higher ozone production rate for supply to the plurality of washing machines.

* * * * *